US006975097B2

(12) United States Patent
Taurand et al.

(10) Patent No.: US 6,975,097 B2
(45) Date of Patent: Dec. 13, 2005

(54) UNITARY MAGNETIC COUPLER AND SWITCH MODE POWER SUPPLY

(75) Inventors: Christophe Taurand, Valence (FR); Philippe Bogdanik, Valence (FR)

(73) Assignee: Thales, Neuilly-Sur-Seine ( * ) Notice: Subject to any disclaimer, the term of this patent is extended or adjusted under 35 U.S.C. 154(b) by 0 days.

(21) Appl. No.: 10/513,019

(22) PCT Filed: Apr. 25, 2003

(86) PCT No.: PCT/FR03/01319

§ 371 (c)(1),
(2), (4) Date: Nov. 1, 2004

(87) PCT Pub. No.: WO03/094181

PCT Pub. Date: Nov. 13, 2003

(65) Prior Publication Data

US 2005/0180177 A1 Aug. 18, 2005

(30) Foreign Application Priority Data

May 3, 2002 (FR) ..... 0205580

(51) Int. Cl.[7] ..... G05F 1/24
(52) U.S. Cl. ..... 323/259; 323/288; 363/56.12
(58) Field of Search ..... 323/225, 259, 323/262, 271, 284, 286, 287, 288; 363/98, 363/21.04, 21.12, 40, 56.12; 336/220

(56) References Cited

U.S. PATENT DOCUMENTS 5,636,108 A 6/1997 Taurand
5,745,351 A 4/1998 Taurand
5,995,398 A * 11/1999 Yamauchi et al. ..... 363/98
6,121,768 A 9/2000 Taurand
6,285,568 B1 9/2001 Taurand
6,462,558 B1 10/2002 Taurand
6,473,323 B1 10/2002 Taurand
6,507,176 B2 * 1/2003 Wittenbreder, Jr. ..... 323/259
6,606,022 B1 8/2003 Taurand

FOREIGN PATENT DOCUMENTS

FR 2 804 789 A 8/2001
GB 551 297 A 2/1943

OTHER PUBLICATIONS

Finnegan T S: "Cuk: The Best SMPS?" Electronics World and Wireless World, Reed Business Publishing, Sutton, Surrey, GB vol 97, No. 1659, 1991, pp. 69-72. (no month).

* cited by examiner

*Primary Examiner*—Jessica Han
(74) *Attorney, Agent, or Firm*—Lowe Hauptman & Berner, LLP

(57) ABSTRACT

The invention relates to a unitary magnetic coupler including a first inductor (Lp) consisting of a first winding of phase ϕ and having a number N of turns between the two ends of the first winding and, magnetically coupled to the first inductor (Lp), a second inductor (Ls) consisting of a second winding of the same phase ϕ and having the same number N of turns between the two ends of the second winding, where the ends of the first and second windings of the unitary magnetic coupler are interconnected using links consisting of capacitors (C1, C2) of equal value.

17 Claims, 9 Drawing Sheets

UNITARY MAGNETIC COUPLER AND SWITCH MODE POWER SUPPLY

CROSS-REFERENCE TO RELATED APPLICATIONS

The present Application is based on International Application No. PCT/FR03/01319, filed on Apr. 25, 2003, entitled "SINGLE UNIT MAGNETIC COUPLER AND SWITCHING POWER SUPPLY", which in turn corresponds to FR 02/05580 filed on May 3, 2002, and priority is hereby claimed under 35 USC §119 based on these applications. Each of these applications are hereby incorporated by reference in their entirety into the present application.

TECHNICAL FIELD

The invention relates to a unitary magnetic coupler.

Other subjects of the invention are a switch mode power supply and data transmission equipment employing such a coupler.

The field of the invention is that of power supplies designed to deliver direct-current from an alternating-current (AC) or direct-current (DC) power distribution network.

BACKGROUND OF THE INVENTION

Specifically, power supplies operating at low power levels, typically less than 150 W, will be considered.

One aim is to minimize the size and weight of the power supplies.

"Flyback" or "forward" power supplies are low-power switch mode power supplies employed frequently, particularly because they are simple to control. The flyback design is a very interesting case because of its reduced size arising from the fact that it needs only one magnetic element to achieve the power conversion.

It will be recalled that in switch mode power supplies the DC voltage is chopped by a switch that is switching on and off at a frequency called the switching frequency.

A flyback power supply configuration and a forward power supply configuration will now be described; these are examples chosen from various known configurations.

A flyback power supply, a circuit diagram of which is shown in FIG. 1*a*), is an energy storage switch mode power supply.

It comprises a primary circuit P consisting of, in series, a voltage source $V_{in}$, a switch M, for example a MOS transistor and an inductor Lp made up of a winding of Np turns, and a secondary circuit S consisting of, in series, an inductor Ls made up of a winding of Ns turns, magnetically coupled to Lp, a capacitor $C_{out}$ connected to a load represented here by a resistor $R_{load}$ and a rectifier D, for example a diode.

For each of the windings of Lp and Ls, the phase $\phi$, corresponding to the direction of the winding, is identified by a circle. In the example shown, the first and second windings have the same phase.

The coupling circuit consisting of the primary inductor Lp and the secondary inductor Ls is denoted by the transformer T.

The current flowing through the primary circuit is $i_p$, and the voltages across the terminals of the primary circuit and across the switch are $V_{in}$ and $V_M$ respectively. The current flowing through the secondary circuit is $i_s$, and the voltages across the terminals of the secondary circuit and across the diode are $V_{out}$ and $V_D$ respectively.

In this "flyback" power supply design, current does not flow through both windings simultaneously. The operation of this power supply, called an "inductive storage" supply, is based on energy transfer cycles made up of a magnetic energy storage phase in the inductive element of the primary circuit (in this case Lp), followed by a phase for transferring this stored energy to a secondary source via the secondary circuit.

The various operating phases of this power supply will now be described, with reference to FIGS. 1*b*) and 1*c*).

Let us first recall a basic principle that underlies some of the explanations to follow: it is impossible to force a voltage discontinuity across the terminals of a capacitor and a current discontinuity in an inductor.

When the switch M is closed (FIG. 1*b*), i.e. during $T_{on}$, the energy is stored in the inductor Lp; the diode does not conduct since the voltage $V_D$ across its terminals is negative and therefore the current $i_s$ is zero.

When the switch M is open, i.e. during $T_{swt}$-$T_{on}$, where $T_{swt}$ is the switching period, the current $i_p$ is zero (FIG. 1*c*). The continuity of the magnetic energy leads to the transfer of the energy stored previously in the inductor Lp to the inductor Ls and also results in the diode D switching to its conducting state: D demagnetizes the transformer T. This phase ends if the current in the diode D falls to zero or if the end of the switching period is reached.

FIGS. 1*d*) and 1*e*) show the waveforms in continuous mode, in which the current $i_s$ does not fall to zero at the end of the conducting phase of the secondary-circuit diode D. To simplify the description, it is assumed that the current $i_p$ changes instantaneously from its maximum value to zero.

The voltage $V_{Lp}$ across the terminals of the inductor Lp, represented in FIG. 1*d*), varies as a function of time between a maximum value of $V_{in}$ and a minimum value of $-V_{out}\times N_p/N_s$.

The current $i_p$, represented in FIG. 1*e*), varies as a function of time between a maximum value of $i_{Max}$ and zero; the current $i_s$ varies as a function of time between zero and a maximum value of $i_{Max}\times N_s/N_p$.

A forward power supply, a circuit diagram of which is shown in FIG. 2*a*), is a switch mode power supply that directly transfers energy.

It comprises a primary circuit P consisting of, in series, a voltage source $V_{in}$, a switch M, for example a MOS transistor and an inductor Lp made up of a winding of Np turns, and, in parallel with the inductor Lp and the switch M, a demagnetizing circuit for demagnetizing the transformer which circuit may be a diode $D_{dem}$ placed in series with an inductor $L_{dem}$, magnetically coupled to Lp, made up of a winding of $N_{dem}$ turns. The diode $D_{dem}$ and the inductor $L_{dem}$ may be replaced by other components.

The secondary circuit S consists of, in series, an inductor Ls made up of a winding of Ns turns, magnetically coupled to Lp, a capacitor $C_{out}$ connected to a load represented here by a resistor $R_{load}$, an inductor L, a first rectifier D1, for example a diode, and, in parallel with the inductor Ls and the rectifier D1, a second rectifier D2 which may also be a diode.

The phase $\phi$ of each of the windings of Lp, $L_{dem}$ and Ls is identified by a circle. In the example given, the windings of Lp and Ls have the same phase, opposite to that of the winding of $L_{dem}$.

As in the previous case, the coupling circuit consisting of the primary inductor Lp, the secondary inductor Ls and the inductor $L_{dem}$ is denoted by the transformer T.

The current flowing through the primary circuit is $i_p$, and the voltages across the terminals of the primary circuit and across the switch are $V_{in}$ and $V_M$ respectively. The current flowing through the secondary circuit is $i_s$, and the voltages across the terminals of the secondary circuit and across the diode D1 are $V_{out}$ and $V_{D1}$ respectively.

In this "forward" power supply design, both windings operate simultaneously; there is a direct transfer of energy between the inductors Lp and Ls.

The various operating phases of this power supply will now be described, with reference to FIGS. 2*b*), 2*c*) and 2*d*).

When the switch M is closed (FIG. 2*b*), i.e. during Ton, some of the energy is stored in the inductor Lp (this energy is a "parasitic" quantity and therefore much less than the energy of the direct transfer) and the remaining energy is directly transferred between the inductors Lp and Ls, and the diode D1 conducts; a current $i_s$ flows in the secondary circuit; the diodes D2 and $D_{dem}$ become nonconducting since the voltages across their terminals are negative.

When the switch M is open (FIG. 2*c*), the diode D1 becomes nonconducting, and the diodes D2 and $D_{dem}$ switch to the conducting state. In accordance with the basic principle stated earlier, the diode D2, called a freewheeling diode, provides continuity of the current is in the inductor L and the diode $D_{dem}$ provides continuity of the magnetic energy stored in the inductor Lp during the previous phase (i.e. during $T_{on}$) by transferring this stored energy to $V_{in}$ over a time given by $T_{on} \times N_{dem}/N_p$: $D_{dem}$ demagnetizes the transformer T.

At the end of the demagnetizing phase (FIG. 2*d*), i.e. during $T_{swt}-T_{on}\times(1+N_{dem}/N_p)$, $D_{dem}$ becomes nonconducting; D2 remains conducting. This is the freewheeling phase.

FIGS. 2*e*) and 2*f*) show the waveforms. To simplify the description, it is assumed that the current $i_p$ changes instantaneously from its maximum value to zero.

The voltage $V_{Lp}$ across the terminals of the inductor Lp, represented in FIG. 2*e*), varies as a function of time between $V_{in}$ and $-V_{in}\times N_p/N_{dem}$.

The current $i_p$, represented in FIG. 2*f*), varies as a function of time between a maximum value of $i_{Maxp}$ and zero; the current $i_s$ varies as a function of time between a maximum value of $i_{Maxs}$ and a minimum value of $i_{min}$.

From now on, it will be generally assumed that a primary circuit P includes at least one switch M placed in series with a voltage source $V_{in}$ and a first inductor Lp, that a secondary circuit includes at least one rectifier D placed in series with a second inductor Ls and a capacitor $C_{out}$ connected to a load, and that the primary and secondary circuits are coupled by a coupling circuit including at least the primary inductor Lp and the secondary inductor Ls magnetically coupled to each other.

One aim is to further reduce the size and weight of these power supplies.

In order to be able to use small components while achieving the same energy conversion possibilities in terms of the power available at the output, the switching frequency must be increased. This has the drawbacks of increasing losses in the transformer and switch-related losses in the other components, which in turn reduces the overall efficiency and therefore raises the temperature and reduces reliability.

High-frequency imperfections in the transformer are conventionally modeled by a leakage inductance Lf in series with the inductor Lp, as shown in FIG. 3*a*) for a flyback power supply and in FIG. 3*b*) for a forward power supply.

In the case of a flyback power supply operating in discontinuous mode, in which the current is falls to zero at the end of the conducting phase of the secondary-circuit diode D, the voltage across the terminals of the switch M when it opens can be given approximately by the following formula:

$$V_M = V_{in} + \frac{Np}{Ns} \times V_{out} + L_f \times \frac{d}{dt} I_p$$

When the switch opens, it is assumed that the current decreases linearly from its maximum value to zero over a time Tfall which is the closed/open switching time of the switch. Therefore, upon opening of the switch M, and with Ton being the time over which the switch M is closed:

$$V_M = V_{in} + \frac{Np}{Ns} \times V_{out} + \frac{L_f}{L_p} \times V_{in} \times \frac{T_{on}}{T_{fall}}$$

Hence, the leakage inductance results in a term representing an overvoltage across the terminals of the switch, in the form:

$$\frac{L_f}{L_p} \times V_{in} \times \frac{T_{on}}{T_{fall}},$$

and the power Pf due to the leakage inductance is:

$$P_f = \frac{1}{2} \times \frac{V_{in}^2 \times T_{on}^2}{L_p^2} \times \frac{1}{T_{swt}} \times L_f,$$

where $T_{swt}$ is the switching period. The energy stored in the leakage inductance is in general dissipated during the switching phases.

Furthermore, the switching-related losses upon opening of the switch are proportional to Tfall.

Therefore, reducing the switching time Tfall reduces the switching-related losses but increases the term representing the overvoltage across the terminals of the switch.

For example, an opening time Tfall 100 times lower than the closure time Ton, and a leakage inductance Lf of about 1% of Lp, results in an overvoltage upon the switching action equal to the power supply voltage Vin. The consequences of this would be disastrous as regards the voltage dimensioning of the switch M, in this case the transistor M which must be a high voltage range transistor and therefore more expensive and less effective.

In the case of a forward power supply, other equations are derived but the same observations are made on interpreting them.

There are several types of circuits for countering the effect of the leakage inductance.

Dissipative RCD (i.e. Resistor, Capacitor, Diode) circuits are very effective in limiting overvoltages but they dissipate all the energy stored in the leakage inductance resulting in a reduction in overall efficiency.

FIG. 4 shows an example of a flyback power supply employing an RCD circuit. The capacitor C limits the term representing the overvoltage upon opening of the switch M; the resistor R discharges the voltage across the terminals of C and thus dissipates the energy stored in the leakage inductance.

Snubber circuits are often employed to reduce the overvoltages across the terminals of the switch M.

FIG. 5 shows an example of a flyback power supply employing a snubber circuit that dissipates very little energy. As in the previous case, the capacitor limits the overvoltages across the terminals of the switch M. To recover the energy stored in C, an oscillating circuit based on L and C inverts the voltage across the terminals of C. In practice, losses in diodes D1 and D2 and in the inductor L limit the portion of energy recovered by the circuit. Furthermore, the oscillations of the LC circuit must be damped, which also reduces the efficiency.

Lastly, such a circuit is more complex and therefore less reliable, and the efficiency of the power supply would have improved only slightly.

SUMMARY OF THE INVENTION

One important aim of the invention is therefore to propose a circuit for reducing, in flyback or forward power supplies, overvoltages across the terminals of the switch M, switching-related losses and losses of energy stored in the leakage inductance.

To achieve these aims, the invention proposes a unitary magnetic coupler including a first inductor Lp consisting of a first winding of phase $\phi$ and having a number N of turns between the two ends of the first winding and, magnetically coupled to the first inductor Lp, a second inductor Ls consisting of a second winding of the same phase $\phi$ and having the same number N of turns between the two ends of the second winding, which unitary magnetic coupler is characterized in that the ends of the first and second windings are interconnected using links consisting of capacitors of equal value.

This type of coupler, in which the inductor of the primary circuit has the same number of turns as the inductor of the secondary circuit, enables the same voltage to exist across the terminals of the primary and secondary windings of the same phase and therefore a capacitive link can be used to counter the effect of the leakage inductance without increasing switching-related losses.

Another subject of the invention is a switch mode power supply having a primary circuit P coupled to a secondary circuit S by means of a magnetic coupling circuit, characterized in that the magnetic coupling circuit is a unitary magnetic coupler as described above.

The power supply may be a flyback type or forward type.

As a preference, the primary circuit P and the secondary circuit S are able to generate at the terminals of each capacitor of the unitary magnetic coupler a voltage that does not change as a function of the switching frequency.

The invention also relates to data transmission equipment including at least one data transmit-receive device connected to a two-wire data bus, characterized in that it includes a unitary coupler as described above, able to connect the data transmit-receive device to the two-wire data bus.

BRIEF DESCRIPTION OF THE DRAWINGS

Other features and advantages of the invention will become apparent on reading the following detailed description, given by way of nonlimiting example and with reference to the accompanying drawings in which.

DETAILED DESCRIPTION

The circuit used to reduce, in a power supply, overvoltages across the terminals of the switch M, switching-related losses and losses of energy stored in the leakage inductance is a unitary coupler.

A unitary coupler is a transformer in which the winding of the inductor Lp of the primary circuit has the same number of turns and the same phase as the winding of the inductor Ls of the secondary circuit.

This also results in the same voltage existing across the terminals of the primary inductor Lp and the secondary inductor Ls and therefore, in accordance with the basic principle stated earlier, a capacitive link can be used between these two inductors to counter the effect of the transformer's leakage inductance.

Figure 6:
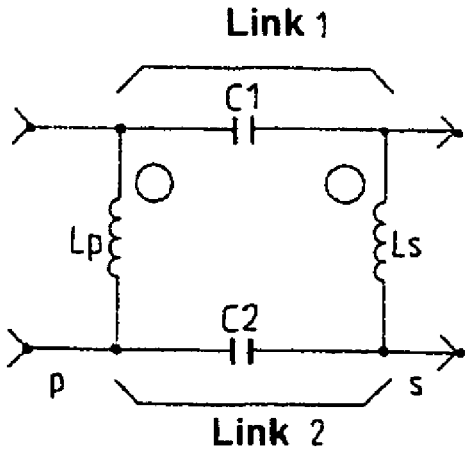
FIG. 6 is a circuit diagram of a unitary coupler according to the invention.

This type of unitary coupler according to the invention is shown FIG. 6. A first link (link 1) consisting of a first capacitor C1 connects the ends of the windings of the inductors Lp and Ls and a second link (link 2) consisting of a second capacitor C2, of the same value as the first capacitor C1, connects the other ends of the inductors Lp and Ls.

This type of coupler achieves coupling at frequencies ranging from relatively low frequencies (of some tens of kHz) to frequencies of some tens of MHz, at the same time reducing losses.

Thus coupling efficiency is increased despite the use of smaller and therefore less expensive components.

The capacitor chosen for the capacitive links has, as a preference, very low parasitic series resistance and inductance. For example, a multilayer ceramic capacitor may be used.

Figure 7A:
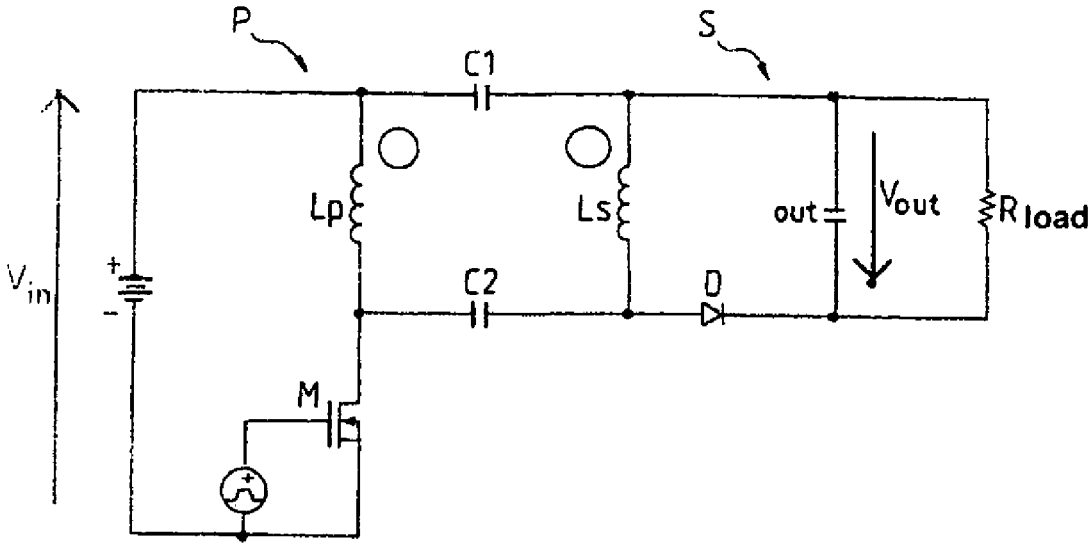
FIGS. 7*a*) and 7*b*) are circuit diagrams of, respectively, a flyback power supply and a forward power supply, with a unitary coupler according to the invention.

This coupler is advantageously used in flyback or forward power supplies as shown in FIGS. 7*a*) and 7*b*).

The capacitive links cancel out the overvoltage across the terminals of the switch M as M opens. Therefore, RCD or snubber circuits need not be added and the switch M need not be overdimensioned in terms of voltage.

Furthermore, the energy stored in the leakage inductance is transferred directly to the capacitive links that transfer this energy to the secondary circuit.

Among the various existing flyback and forward power supply configurations, some generate high common mode voltages at the switching frequency. Configurations that minimize the common mode voltages between the primary and secondary circuits are chosen so that the capacitive links can be used, i.e. configurations for which the voltage across the terminals of capacitor C1 (respectively C2) does not vary as a function of the switching frequency.

A flyback power supply that does not generate high common mode voltages at the switching frequency, and that employs a unitary coupler according to the invention is shown in FIG. 7*a*).

It comprises a primary circuit P consisting of, in series, a voltage source $V_{in}$, an inductor Lp and a switch M, and a secondary circuit S consisting of, in series, a capacitor $C_{out}$ connected to a load represented here by a resistor $R_{load}$, a rectifier D and an inductor Ls.

The coupling circuit between the primary circuit P and the secondary circuit S comprises a unitary coupler according to the invention; the inductors Lp and Ls are therefore identical and connected by capacitive links of equal value.

An experimental flyback power supply employing a unitary coupler according to the invention has been produced. For an input voltage $V_{in}$=28 V DC and a power P=50 W, an efficiency gain of about 2 to 5% was achieved with a lowering of overvoltages upon switch-opening by a ratio of 4.

Figure 7B:
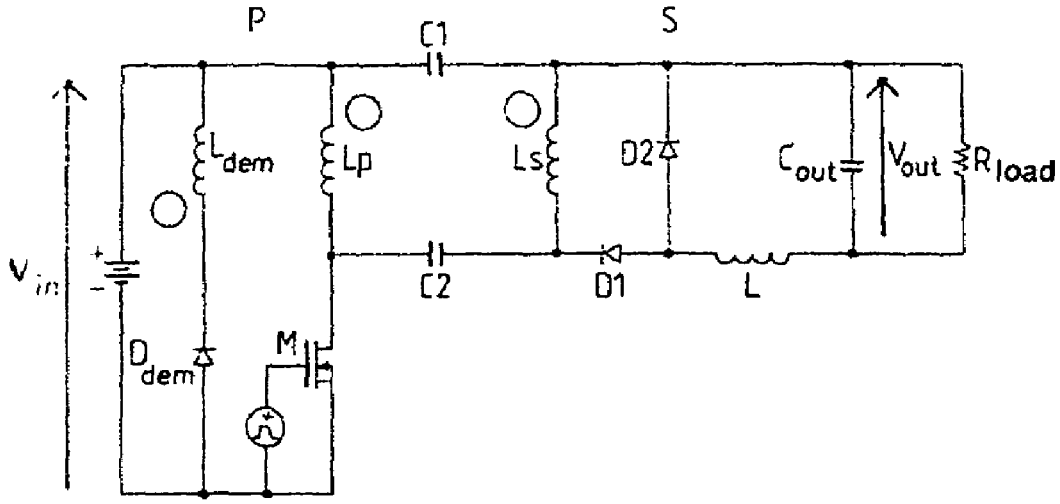

A forward power supply that does not generate high common mode voltages at the switching frequency, and that employs a unitary coupler according to the invention is shown in FIG. 7*b*).

Figure 1A:
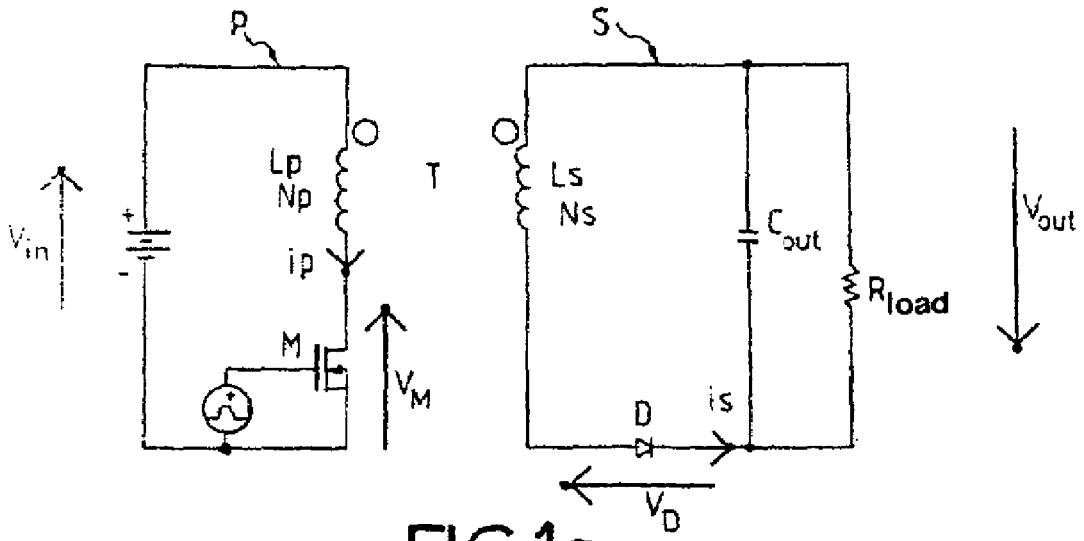
FIGS. 1*a*) to 1*e*) described earlier schematically show, respectively, a flyback power supply, its operating phases when the switch is closed and then open, and its waveforms.
Figure 1B:
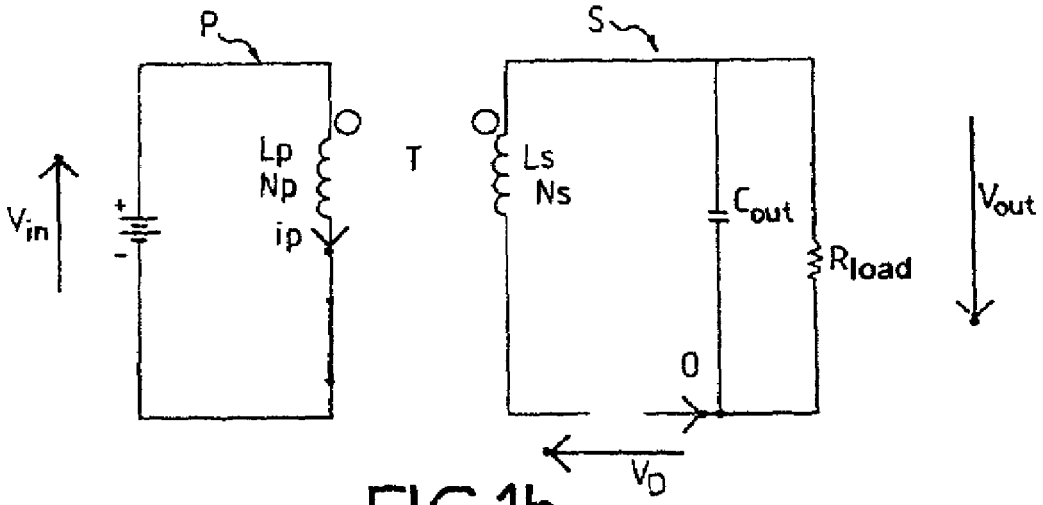
Figure 1C:
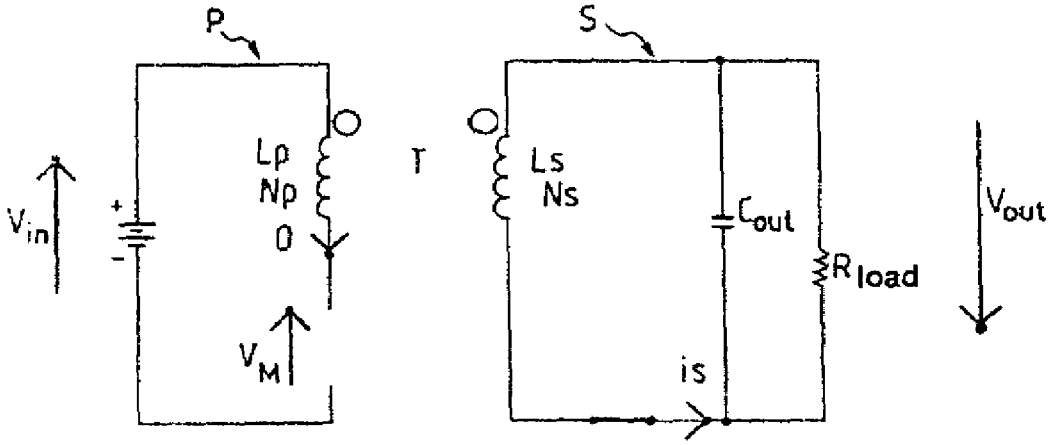
Figure 1D:
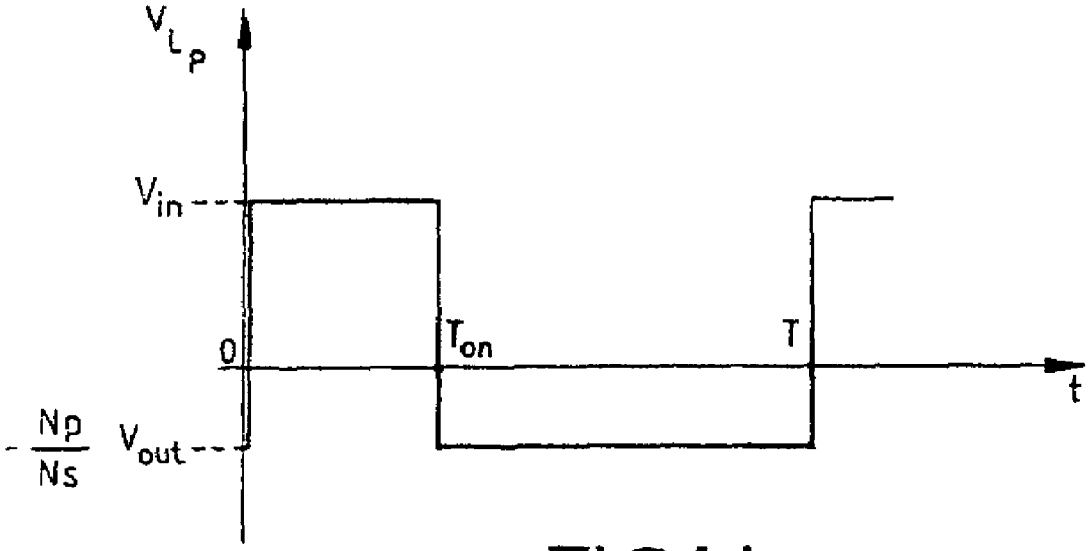
Figure 1E:
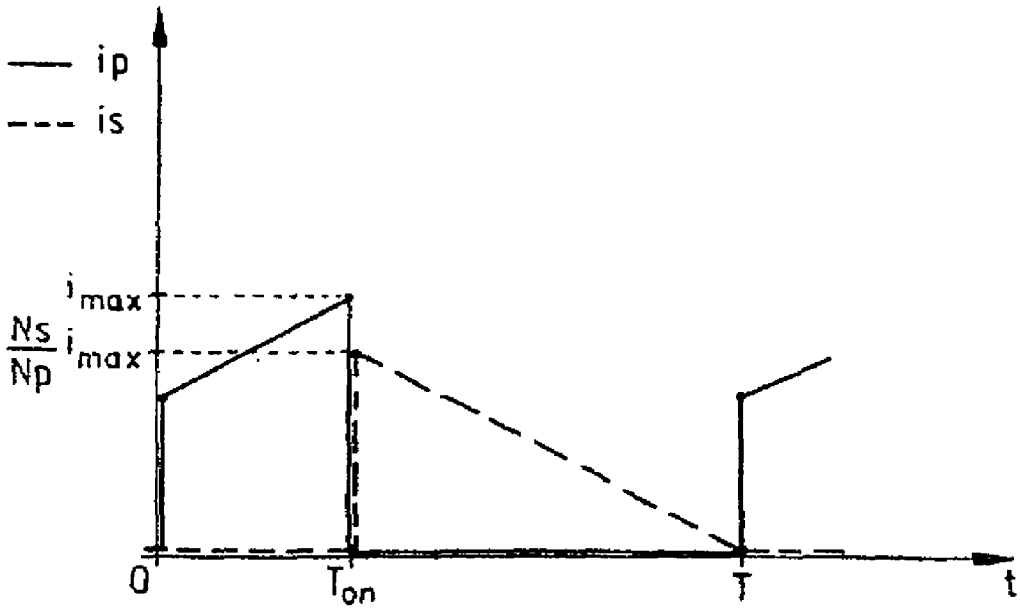
Figure 2A:
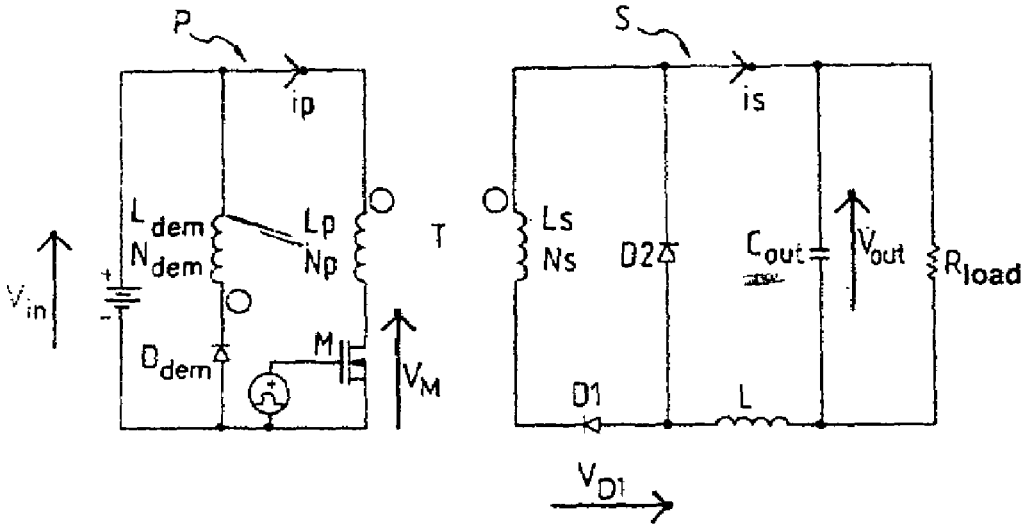
FIGS. 2*a*) to 2*f*) described earlier schematically show, respectively, a forward power supply, its operating phases when the switch is closed and then open, then when the diode $D_{dem}$ is also open, and its waveforms.
Figure 2B:
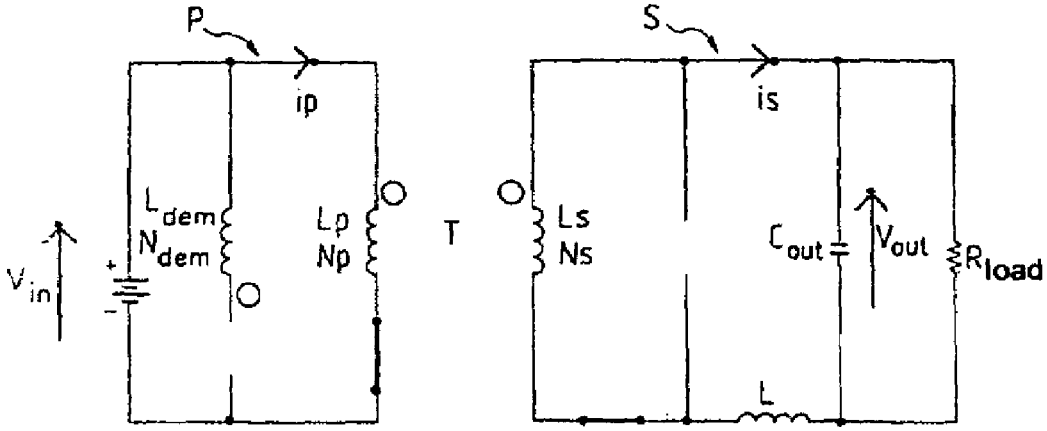
Figure 2C:
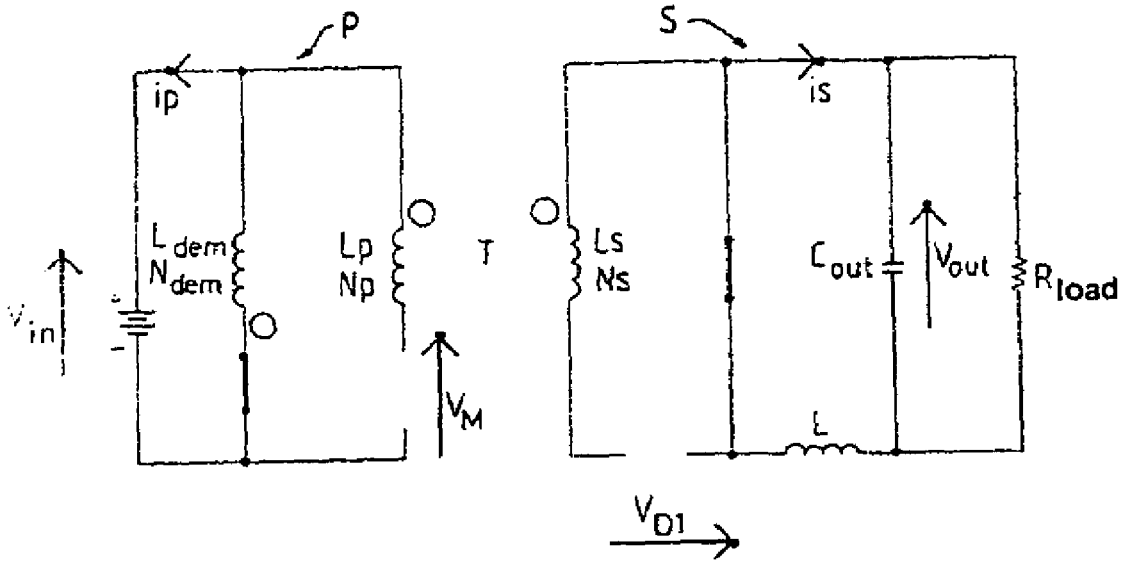
Figure 2D:
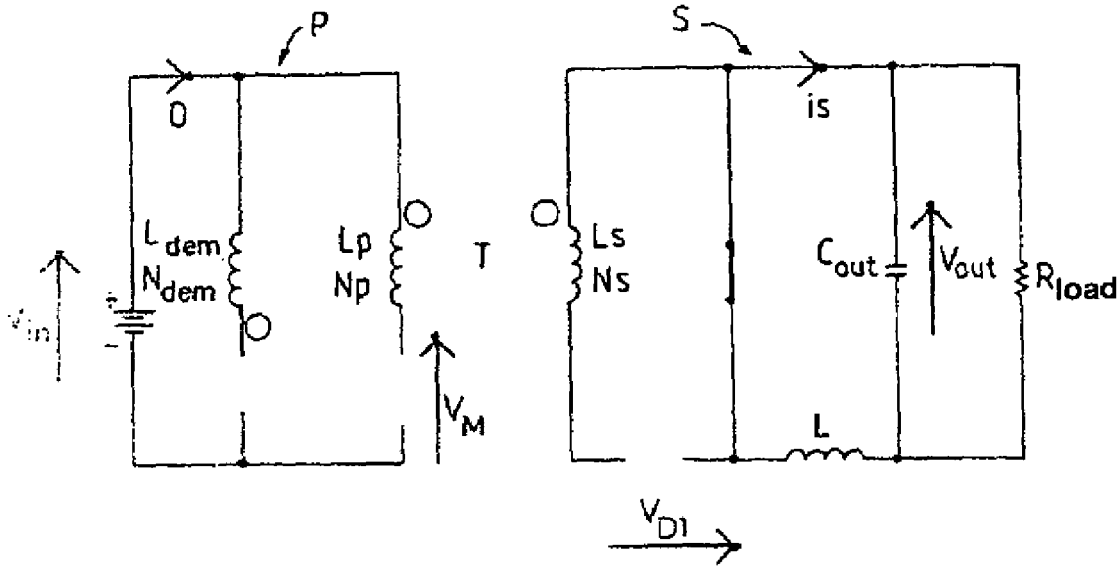
Figure 2E:
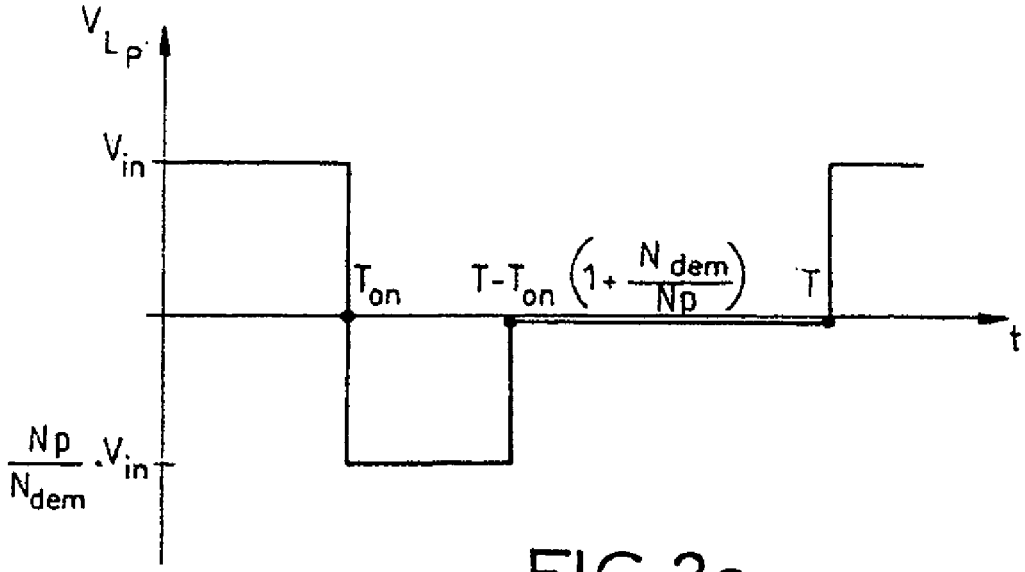
Figure 2F:
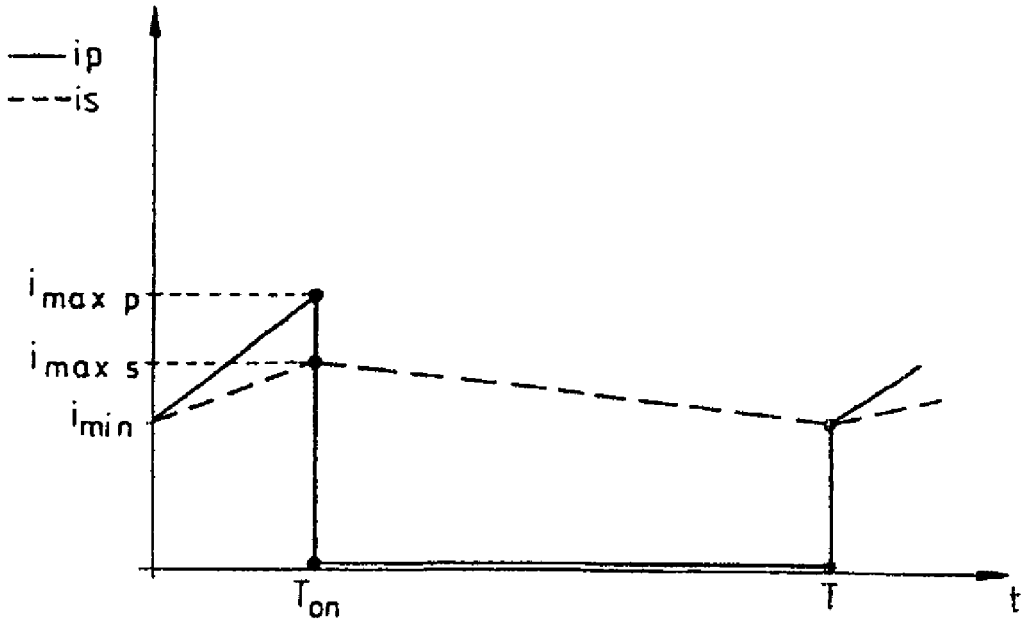
Figure 3A:
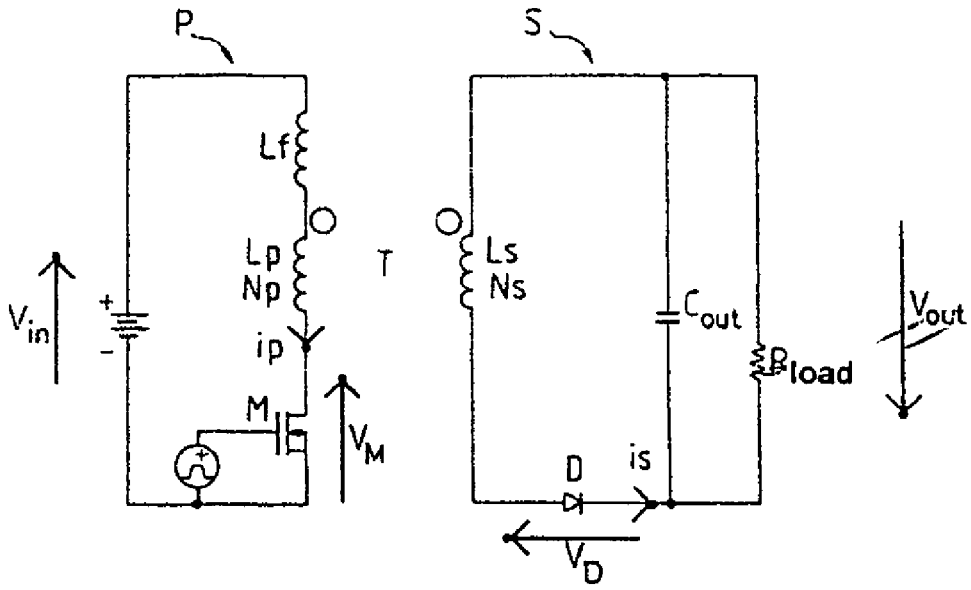
FIGS. 3*a*) and 3*b*) described earlier are circuit diagrams of, respectively, a flyback power supply and a forward power supply, with leakage inductance.
Figure 3B:
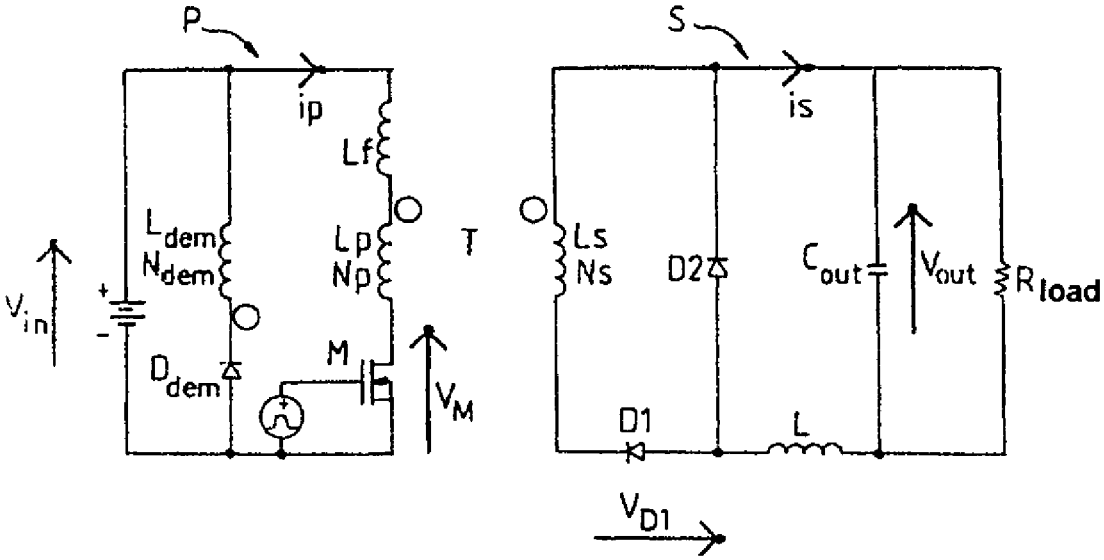
Figure 4:
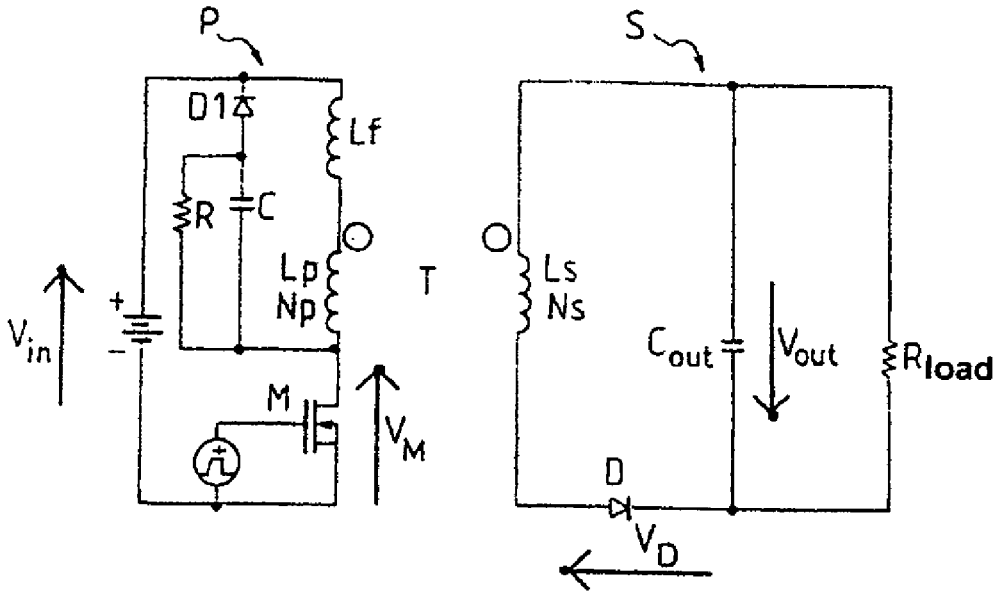
FIG. 4 described earlier is a circuit diagram of a flyback power supply with a dissipative RCD circuit.
Figure 5:
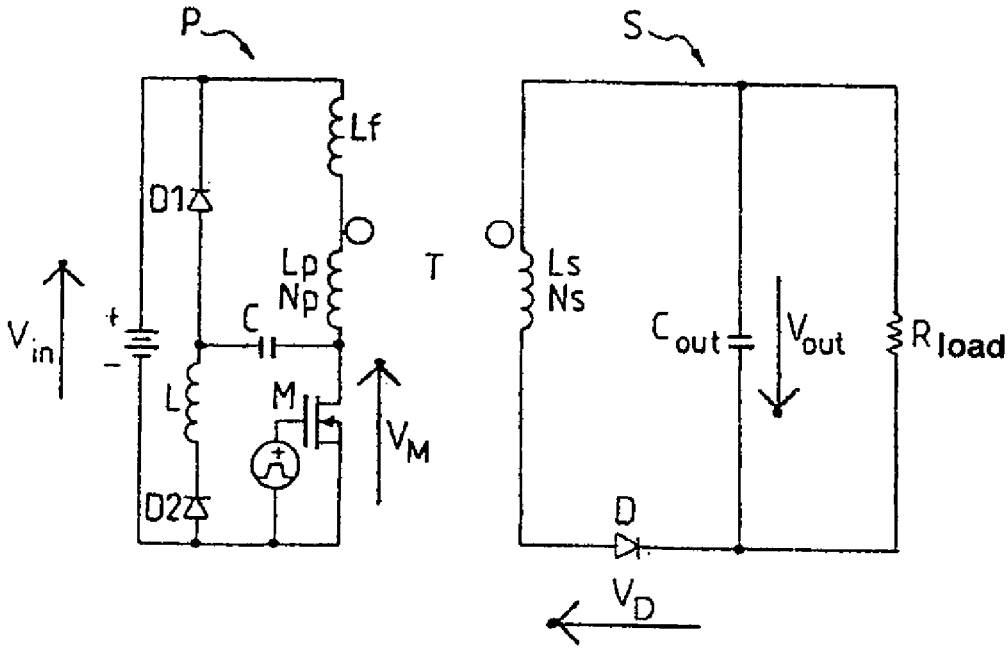
FIG. 5 described earlier is a circuit diagram of a flyback power supply with a snubber circuit that dissipates very little energy.

It comprises a primary circuit P consisting of, in series, a voltage source $V_{in}$, an inductor Lp and a switch M, and, in parallel with the inductor Lp and the switch M, means for demagnetizing the transformer, for example as per FIG. 2*a*). It also comprises a secondary circuit S consisting of, in series, a capacitor $C_{out}$ connected to a load represented here by a resistor $R_{load}$, an inductor L, a first rectifier D1 and an inductor Ls, and, in parallel with the rectifier D1 and the inductor Ls, a rectifier D2.

The coupling circuit between the primary circuit P and the secondary circuit S comprises a unitary coupler according to the invention; the inductors Lp and Ls are therefore identical and connected by capacitive links of equal value.

The unitary coupler according to the invention can be applied in particular to power supplies in which a MOS transistor is used for the switch M, and/or in which uncontrolled rectifiers such as diodes, or even controlled rectifiers such as MOS transistors, are used for the rectifiers D1, D2 and/or $D_{dem}$.

The unitary coupler according to the invention can in particular be applied to inductive storage converters such as the ones described in U.S. Pat. No. 2,729,471, 2,729,516 and 2,773,013.

The power supplies described achieve improved efficiency and a lowering of the overvoltages across the terminals of the switch, without a significant increase in the complexity of the circuits as would be the case for circuits that include RCD or snubber circuits.

Using capacitors means that high-frequency coupling can be achieved, at frequencies beyond 100 MHz. The unitary coupler according to the invention may hence be used to transmit data at high frequency: the capacitive coupling means that a high-speed data transmission is possible, which is relayed by the magnetic coupling at frequencies ranging from some tens of kHz to several tens of MHz.

Figure 8:
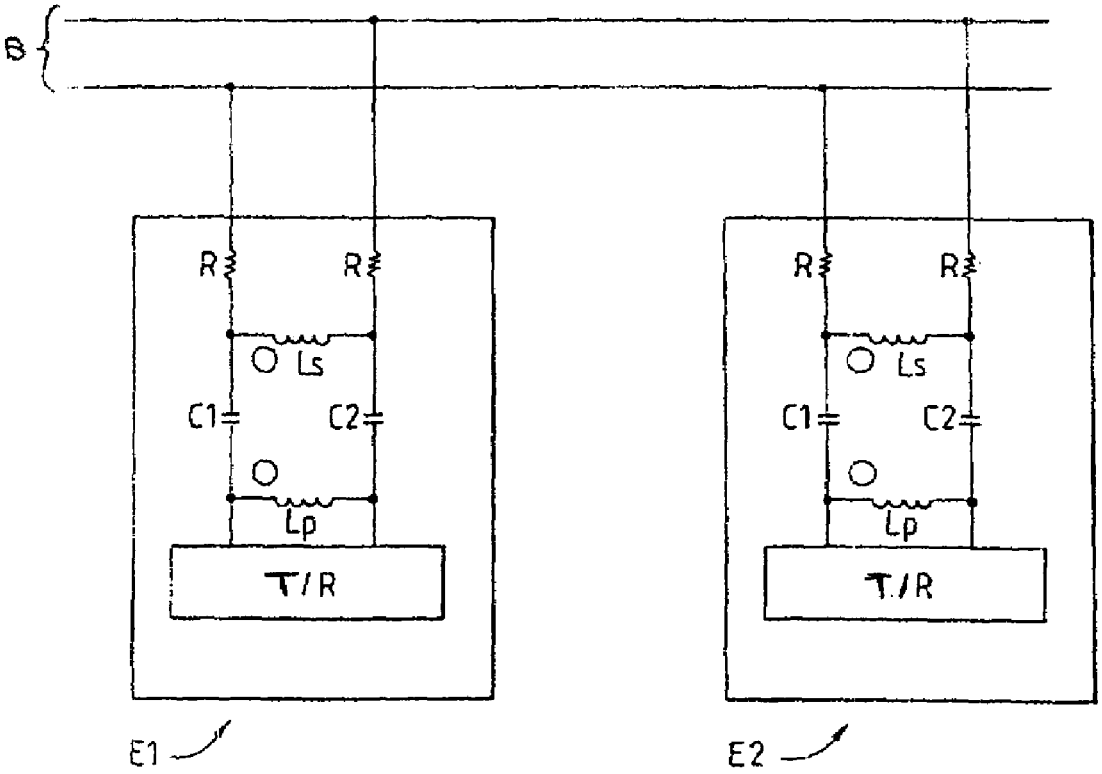
FIG. 8 is a circuit diagram of an example data transmission system with a unitary coupler according to the invention.

An example data transmission system is shown in FIG. 8. It is made up of two modules E1 and E2 interconnected via a two-wire data bus B. Each module E1 and E2 has a data transmit-receive device T/R connected to the data bus B by means of a unitary coupler according to the invention and resistors R.

More generally, the coupler according to the invention may be applied to any device employing a magnetic transformer.

The invention claimed is:

1. A unitary coupler, the coupler comprising:

a first inductor having a first winding of phase $\phi$ and having a number N of turns between the two ends of the first winding; and, a second inductor, magnetically coupled to the first inductor, having a second winding of the same phase $\phi$ and having the same number N of turns between the two ends of the second winding, wherein the ends of the first and second windings are interconnected using links consisting of capacitors of equal value.

2. A switch mode power supply having a primary circuit coupled to a secondary circuit by means of a coupling circuit comprising:

a unitary coupler as claimed in claim 1.

3. The switch mode power supply as claimed in claim 2, wherein the power supply is a flyback type power supply.

4. The switch mode power supply as claimed in claim 3, wherein the primary circuit includes at least one switch placed in series with a voltage source and the first inductor, and the secondary circuit includes at least one rectifier placed in series with the second inductor and a capacitor connected to a load.

5. The coupler as claimed in claim 4, wherein the switch is a MOS transistor.

6. The coupler as claimed in claim 4, wherein the rectifier is at least one of a diode and a MOS transistor.

7. The switch mode power supply as claimed in claim 3 wherein the primary circuit and the secondary circuit are able to generate at the terminals of each capacitor of the unitary coupler a voltage that does not change as a function of the switching frequency.

8. The switch mode power supply as claimed in claim 2, wherein the power supply is a forward type power supply.

9. The switch mode power supply as claimed in claim 8, wherein the primary circuit includes at least one switch placed in series with the first inductor and a voltage source and, in parallel with the switch and the first inductor, a demagnetizing circuit for demagnetizing the magnetic transformer, and the secondary circuit additionally includes, in series with the second inductor, a capacitor connected to a load, a third inductor, a first rectifier, and, in parallel with the second inductor and the first rectifier, a second rectifier.

10. The coupler as claimed in claim 9, wherein the switch is a MOS transistor.

11. The coupler as claimed in claim 9, wherein at least one of the first and second rectifier is at least one of a diode and a MOS transistor.

12. The switch mode power supply as claimed in claim 8 wherein the primary circuit and the secondary circuit are able to generate at the terminals of each capacitor of the unitary coupler a voltage that does not change as a function of the switching frequency.

13. The switch mode power supply as claimed in claim 2 wherein the primary circuit and the secondary circuit are able to generate at the terminals of each capacitor of the unitary coupler a voltage that does not change as a function of the switching frequency.

14. Data transmission equipment including at least one data transmit-receive device connected to a two-wire data bus, including a unitary coupler as claimed in claim 1, able to connect the data transmit-receive device to the two-wire data bus.

15. The coupler as claimed in claim 1, wherein the capacitors have very low parasitic series resistance and inductance.

16. The coupler as claimed in claim 1, wherein the capacitors are multilayer ceramic capacitors.

17. The coupler as claimed in claim 1, wherein coupling occurs greater than or equal to 100 MHz.

* * * * *